US007414833B2

(12) United States Patent
Kittayapong

(10) Patent No.: US 7,414,833 B2
(45) Date of Patent: Aug. 19, 2008

(54) PORTABLE COMPUTER CASE

(76) Inventor: Rungrith Kittayapong, 0505 Hasbrouck Apartment, Ithaca, NY (US) 14850

( * ) Notice: Subject to any disclaimer, the term of this patent is extended or adjusted under 35 U.S.C. 154(b) by 269 days.

(21) Appl. No.: 11/490,958

(22) Filed: Jul. 21, 2006

(65) Prior Publication Data

US 2008/0017541 A1 Jan. 24, 2008

(51) Int. Cl.
*G06F 1/16* (2006.01)

(52) U.S. Cl. ..... 361/681; 206/320; 190/110; 345/426; 400/693

(58) Field of Classification Search ..... 206/320, 206/521, 760; 224/575, 625; 190/1, 107, 190/110; 345/426, 462.43; 244/2, 76 R; 400/613, 693; 361/679–687, 724–727
See application file for complete search history.

(56) References Cited

U.S. PATENT DOCUMENTS

| | | | | |
|---|---|---|---|---|
| 5,377,794 | A | 1/1995 | Book | 190/1 |
| D360,075 | S | 7/1995 | Cross et al. | D3/276 |
| 5,445,266 | A | 8/1995 | Prete et al. | 206/320 |
| 5,494,157 | A | 2/1996 | Golenz et al. | 206/370 |
| 5,524,754 | A | 6/1996 | Hollingsworth | 206/320 |
| 5,607,054 | A | 3/1997 | Hollingsworth | 206/320 |
| 5,775,497 | A | 7/1998 | Krulik | 206/320 |
| 5,887,723 | A | 3/1999 | Myles et al. | 206/760 |
| 5,938,096 | A | 8/1999 | Sauer et al. | 224/625 |
| D414,751 | S | 10/1999 | Yogalingam | D14/106 |
| D428,255 | S | 7/2000 | Kandalepas | D3/301 |
| 6,109,434 | A | 8/2000 | Howard, Jr. | 206/320 |
| 6,116,418 | A | 9/2000 | Sadow | 206/320 |
| 6,149,001 | A | 11/2000 | Akins | 206/320 |
| 6,269,948 | B1 | 8/2001 | Jackson | 206/320 |
| 6,354,477 | B1 | 3/2002 | Trummer | 224/575 |
| D462,518 | S | 9/2002 | Truffier-Blanc et al. | D3/273 |
| 6,763,942 | B1 | 7/2004 | Yeh | 206/320 |
| 6,896,134 | B2 | 5/2005 | Russell et al. | 206/320 |
| 7,251,127 | B2 * | 7/2007 | Ghosh et al. | 361/683 |
| 2003/0223119 | A1 | 12/2003 | Heiman | 359/610 |
| 2004/0011616 | A1 | 1/2004 | Rasmussen | 190/107 |
| 2004/0217027 | A1 | 11/2004 | Harris et al. | 206/320 |
| 2006/0037987 | A1 | 2/2006 | Lin | 224/646 |

* cited by examiner

*Primary Examiner*—Hung V Duong
(74) *Attorney, Agent, or Firm*—Joseph M. Maraia, Esq.; Foley & Lardner LLP

(57) ABSTRACT

Cases and methods of use of a laptop computer are provided such that the laptop computer need not be removed from the case, enabling use of the laptop computer keyboard, display and ports located on a back edge of the laptop computer while the laptop computer remains in the case. According to example of the invention, a case for a laptop computer is provided having first and second portions formed of rigid material. The first portion is adapted to be secured to a display portion of the laptop computer, and the second portion adapted to be secured to a keyboard portion of the laptop computer. Opening and closing the laptop computer is thereby permitted. A covering flap is also provided to be selectively securable across the connective portion. Another embodiment of the invention is usable with laptop computers having a multi-axis rotation display portion.

23 Claims, 5 Drawing Sheets

PORTABLE COMPUTER CASE

BACKGROUND

Computers, particularly portable computers such as laptop computers, are susceptible to damage caused by impacts. Typically, bags or briefcases are used to attempt to protect a laptop computer during transport. These bags or briefcases are padded and simply form an enclosure from which the laptop computer is removed when the laptop computer is used. Such a bag or briefcase therefore provides no protection when the laptop computer is in use. Also, removal of the laptop computer from the bag or briefcase can be cumbersome and potentially introduce another opportunity for the computer to be damaged while being lifted out of the bag or briefcase.

SUMMARY

Embodiments of the present invention may be used in a wide variety of applications so as to provide a case for a laptop computer, or a method of use for a laptop computer, to provide for operation of the computer without a need for removal of the computer from the case. Various embodiments of the invention may therefore provide enhanced ease of use because the laptop computer need not be removed from a bag or briefcase. Furthermore, because the laptop computer need not be lifted in an unprotected state, opportunities for damage of the laptop computer may be reduced.

According to one illustrative embodiment of the invention, a case for a laptop computer is provided having first and second portions formed of rigid material. The first portion is adapted to be secured to a display portion of the laptop computer, and the second portion adapted to be secured to a keyboard portion of the laptop computer. A connective portion is provided connecting the first portion to the second portion. Opening and closing the laptop computer is thereby permitted. A covering flap is also provided to be selectively securable across the connective portion. According to this illustrative embodiment of the invention, the first portion and second portion remain secured to the display and keyboard portions, respectively, during operation of the laptop computer in an open configuration.

In another illustrative embodiment of the invention, a method of use of a laptop computer is provided. The method includes the act of mounting the display portion of the laptop computer to a first portion formed of a rigid material and the act of mounting the keyboard portion of the laptop computer to a second portion formed of rigid material. A connective portion is located proximate to a plurality of ports on a back edge of the laptop computer. The connective portion connects the first and second portions to enable rotation of the first portion relative to the second portion. A covering flap is opened to expose the connective portion and the plurality of ports. At least one wire is inserted in at least one port of the plurality of ports. Data is input into the laptop computer by the use of the keyboard portion. According to this illustrative embodiment of the invention, the display portion and the keyboard portion remain mounted to the first and second portions, respectively, during the act of inputting data into the laptop computer.

According to a further illustrative embodiment of the invention, a case for a laptop computer is provided. According to this embodiment, a first portion is formed of rigid material and is adapted to be secured to a display portion of the laptop computer. A second portion is formed of rigid material and adapted to be secured to a keyboard portion of the laptop computer. A covering flap is selectively securable between the first and second portions to enable rotation of the first portion relative to the second portion along a first axis. Opening and closing the laptop computer is thereby permitted when the covering flap is secured between the first portion and the second portion when the covering flap is secured between the first and second portion. The covering flap also enables rotation when detached from the first portion or the second portion, thereby enabling rotation of the display portion of the laptop computer along the second axis. According to this embodiment the first and second portions remain secured to the display portion and keyboard portion respectively during application of the laptop computer in an open configuration.

BRIEF DESCRIPTION OF THE DRAWINGS

The invention will be apparent from the description herein and the accompanying drawings.

DETAILED DESCRIPTION

According to various embodiments of the invention, cases and methods of use of a laptop computer are provided. Various embodiments of the invention are provided such that the laptop computer need not be removed from the case, enabling use of the laptop computer keyboard, display and ports located on a back edge of the laptop computer while the laptop computer remains in the case.

Figure 1:
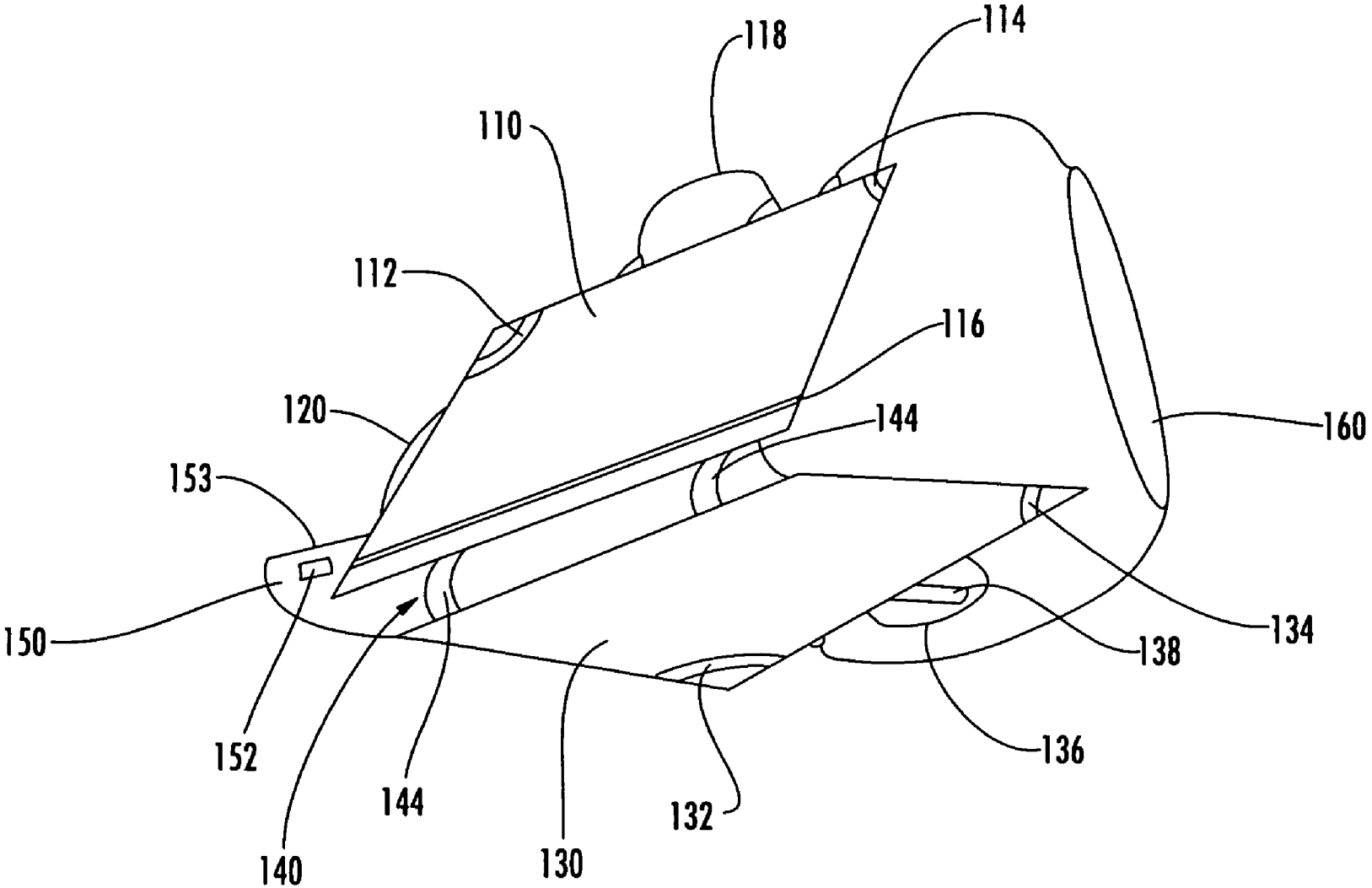
FIG. 1 is an illustration of an example of a case for a laptop computer according to an illustrative embodiment of the invention.

An illustrated embodiment of a case 100 for a laptop computer is shown in FIG. 1. According to the illustrative embodiment, a first portion 110 is provided to be secured to a display portion of the laptop computer. A corresponding second portion 130 is also provided and is adapted to be secured to a keyboard portion of the laptop computer. The first portion 110 is provided with a first socket 112 and a second socket 114. The sockets may be formed of a band of elastic material, non-elastic fabric or metal such as, for example, aluminum and are sized and configured to hold a corner of the first portion 110 proximate to the corresponding corner of the display portion of the laptop computer. Optionally, plastic clips, such as those used with a clipboard. A lower band 116 may be used to hold the lower portion of the display portion of the laptop computer proximate to the first portion 110 of the case 100 for the laptop computer. The lower band 116 may be secured on both ends to the first portion 110 or may be removable on one or both ends so as to more easily insert the laptop computer into the case 100. Optionally, at least one pocket 120 may be provided on an exterior surface of the first portion 110, so as to enable the carrying of additional supplies. It is understood that the pocket 120 may be formed in a wide variety of configurations. A handle 118 may be provided for holding the case 100 during travel.

The second portion 130 according to the illustrative embodiment of FIG. 1 is provided with a third socket 132 and a fourth socket 134. Similar to the first socket 112 and the second socket 114, the third socket 132 and fourth socket 134 are sized and configured to hold corners of the laptop computer relative to corners of a portion of the case 100. The third socket 132 and fourth socket 134 are sized and configured to hold corners of the keyboard portion of the laptop computer. The third socket 132 and fourth socket 134, like the first socket 112 and second socket 114, may be made of elastic or a non-elastic fabric material. The second portion 130 may also include a handle 136 that may be used in conjunction with the handle 118 of the first portion 110 during transport of the case 100. A closure strap 138 may be provided on either of the first portion 110 or second portion 130 and removably securable to the other of the first portion 110 and second portion 130, so as to be able to secure the distant ends of the first portion 110 and second portion 130 relative to each other, maintaining the case 100 in a closed position. The closure strap 138 may attach to the first portion 110 in the illustrative embodiment by the use of a magnet and/or a buckle or snap fastener or button.

The case 100 further includes a connective portion 140 that is configured to secure the first portion 110 and second portion 130 relative to each other so as to enable rotation of the first portion 110 relative to the second portion 130, thereby permitting opening and closing of the laptop computer. According to the illustrative embodiment of FIG. 1, the connective portion 140 is formed by two straps 144 that are each secured to the first portion 110 and second portion 130. The connective portion 140 may also be formed of material having holes located so as to be proximate to corresponding ports on the back edge of the laptop computer.

A covering flap 150 is also provided with the case 100 for the laptop computer. The covering flap 150 is secured to the first portion 110 or the second portion 130 and removably securable to the other of the first portion 1 10 and second portion 130. According to the illustrative embodiment in FIG. 1, the covering flap 150 is selectively securable to the first portion 110 by the use of one or more hook and loop fasteners 152, zipper 153, buckles, magnets and/or snap fasteners. The covering flap 150 can therefore be selectively detached from the first portion 110 thereby enabling access to a back edge of the laptop computer so as to enable various cables to be connected to the back edge of the laptop computer while simultaneously maintaining the laptop computer within the case 100 while the case is in an open or closed position.

Various components of the case 100 may be formed of a wide variety of materials. The first portion 110 and second portion 130 may be formed of a rigid, planar material so as to provide some protection for the laptop computer. Real leathers, cow skins, hides, various fabrics, including cotton or synthetic fabrics such as dernier, nylon, or other fabrics that will be apparent to one of ordinary skill in the art, are within the scope of the invention. Methods of construction may include various stitching, adhesive, and/or fasteners, including rivets or staples may be apparent to one of ordinary skill in the art and are included within the scope of the invention.

The sizing of the first portion 110 and second portion 130 may be slightly oversized relative to the size of the computer, thereby providing additional protection by locating the laptop computer in a recessed position from the outer perimeter of the first portion 110 and second portion 130. However, the invention is not so limited and the first portion 110 and second portion 130 may matched to the size of the computer.

Optionally, a shoulder strap 160 may be provided to be detachably connected to one or both of the first portion 110 and second portion 130, so as to enhance the ease of carrying the case 100. According to the illustrative embodiment in FIG. 1, the shoulder strap 160 is attached to both the first portion 110 and the second portion 130 and detachable from both portions.

Figure 2:
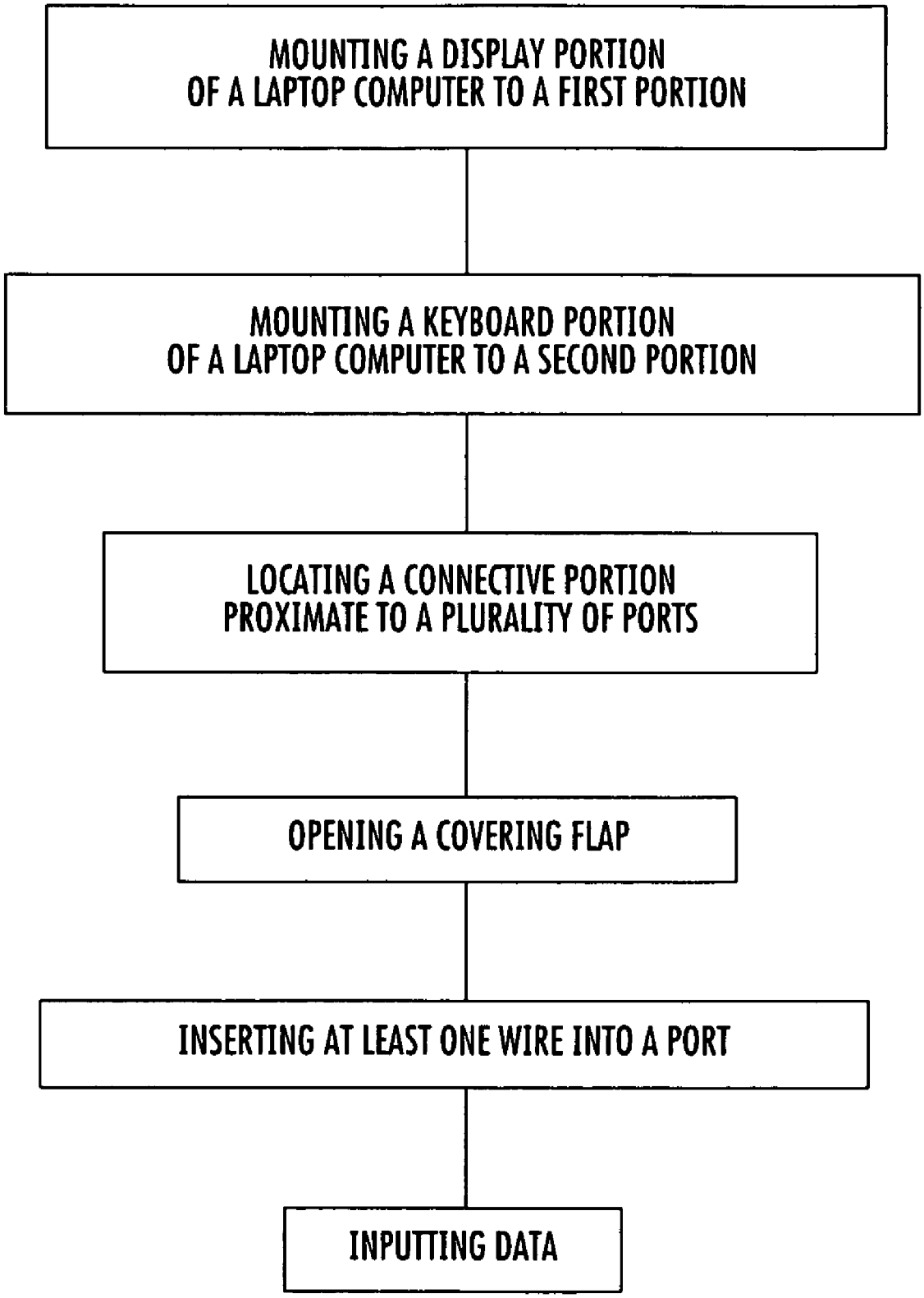
FIG. 2 is an illustration of an example of a method according to an illustrative embodiment of the invention.

According to another illustrative embodiment of the invention, a method 200 of use of a laptop computer is provided and illustrated by way of example in FIG. 2. The method 200 includes the act of mounting 210 the display portion of the laptop computer to a first portion formed of a rigid material and the act of mounting 220 the keyboard portion of the laptop computer to a second portion formed of rigid material. A connective portion is located 230 proximate to a plurality of ports on a back edge of the laptop computer. The connective portion connects the first and second portions to enable rotation of the first portion relative to the second portion. A covering flap is opened 240 to expose the connective portion and the plurality of ports. At least one wire is inserted 250 in at least one port of the plurality of ports. Data is input 260 into the laptop computer by the use of the keyboard portion. According to this illustrative embodiment of the invention, the display portion and the keyboard portion remain mounted to the first and second portions, respectively, during the act of inputting data into the laptop computer.

Figure 3:
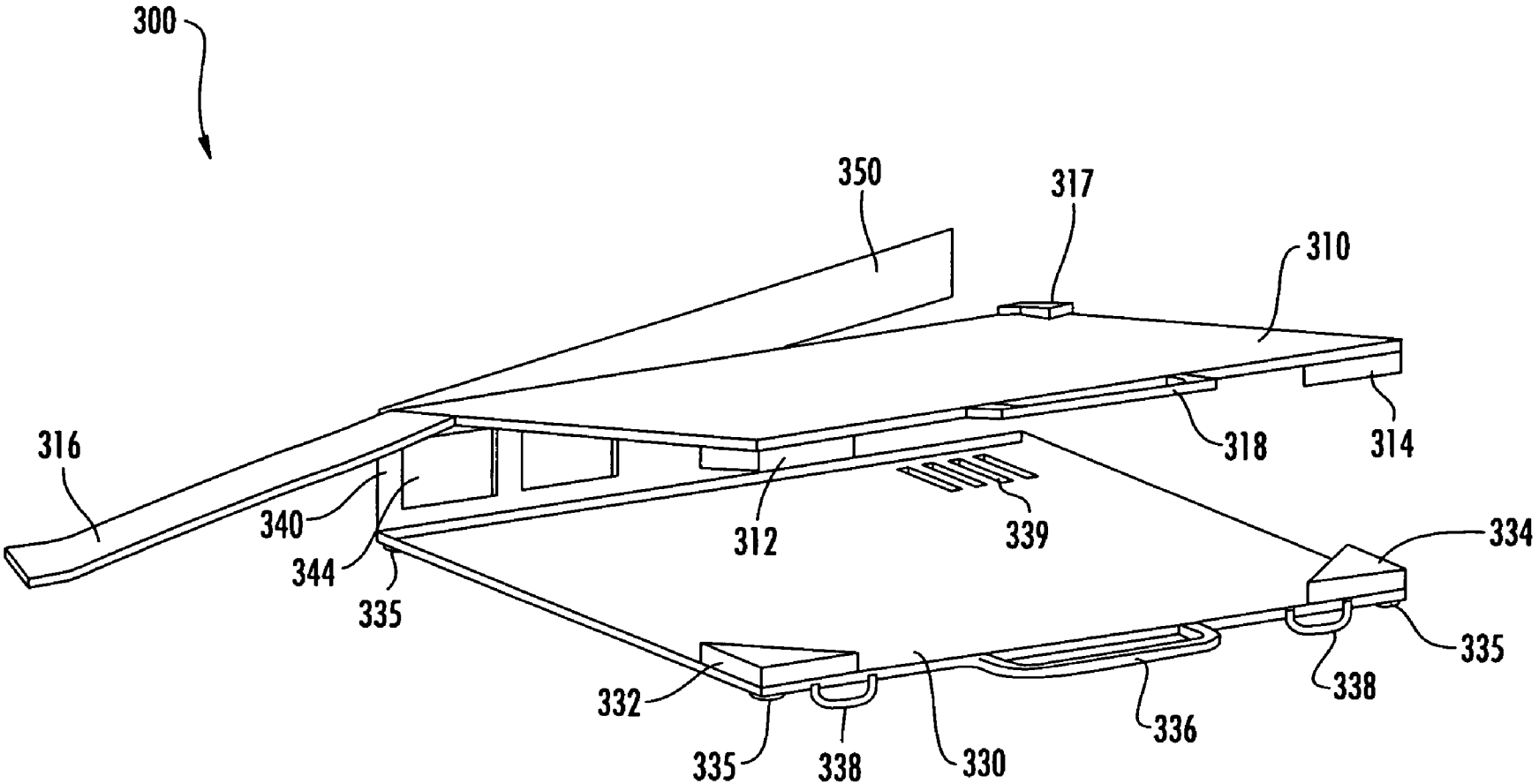
FIG. 3 is an illustration of an example of a case for a laptop computer according to another illustrative embodiment of the invention.

According to another illustrative embodiment of the invention, a case 300 for a laptop computer is illustrated in FIG. 3. Similar to the case 100 of FIG. 1, the case 300 of FIG. 3, includes a first portion 310 and a second portion 330. The first portion 310 includes a first socket 312 and second socket 314 and a lower band 316 that is releasably attachable by the use of a lock or any other securing mechanism, such as a hook and loop fastener 317. A handle 318 is also provided, similar to the embodiment of FIG. 1.

The second portion 330 includes a third socket 332 and fourth socket 334. Pads 335 are also provided on the corners to minimize slippage of the case 300 on a table or other surface. The handle 336 is provided to aid in transport of the case 300. Loops 338 can be provided to attach a shoulder strap. The second portion 330 may also be formed with one or more ventilation ports 339 to enhance the cooling capability of the laptop computer by enabling air to pass through the ports 339.

The connective portion 340 of the illustrative embodiment of FIG. 3 is formed of a material having holes 344 located to be proximate to corresponding ports on a back edge of the laptop computer. A covering flap 350 is provided, attached at one end to the connective portion 340. However, the illustrative embodiment may be implemented with the covering flap 350 attached to the first or second portions 310, 330 along an edge, similar to the covering flap 150 of the illustrative embodiment of FIG. 1.

Figure 4:
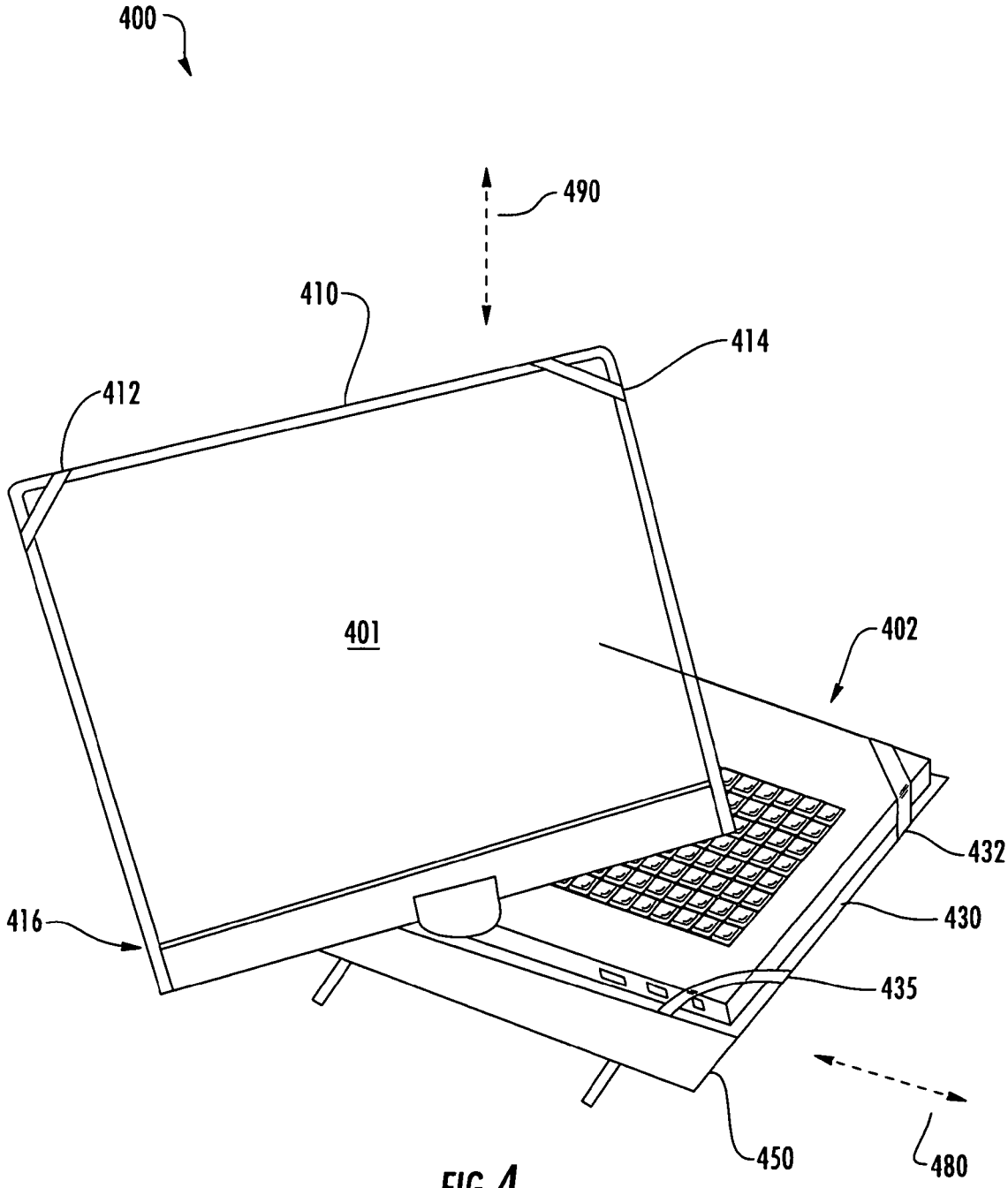
FIGS. 4 and 5 are illustrations of an example of a case for a multi-axis rotation laptop computer according to another illustrative embodiment of the invention.
Figure 5:
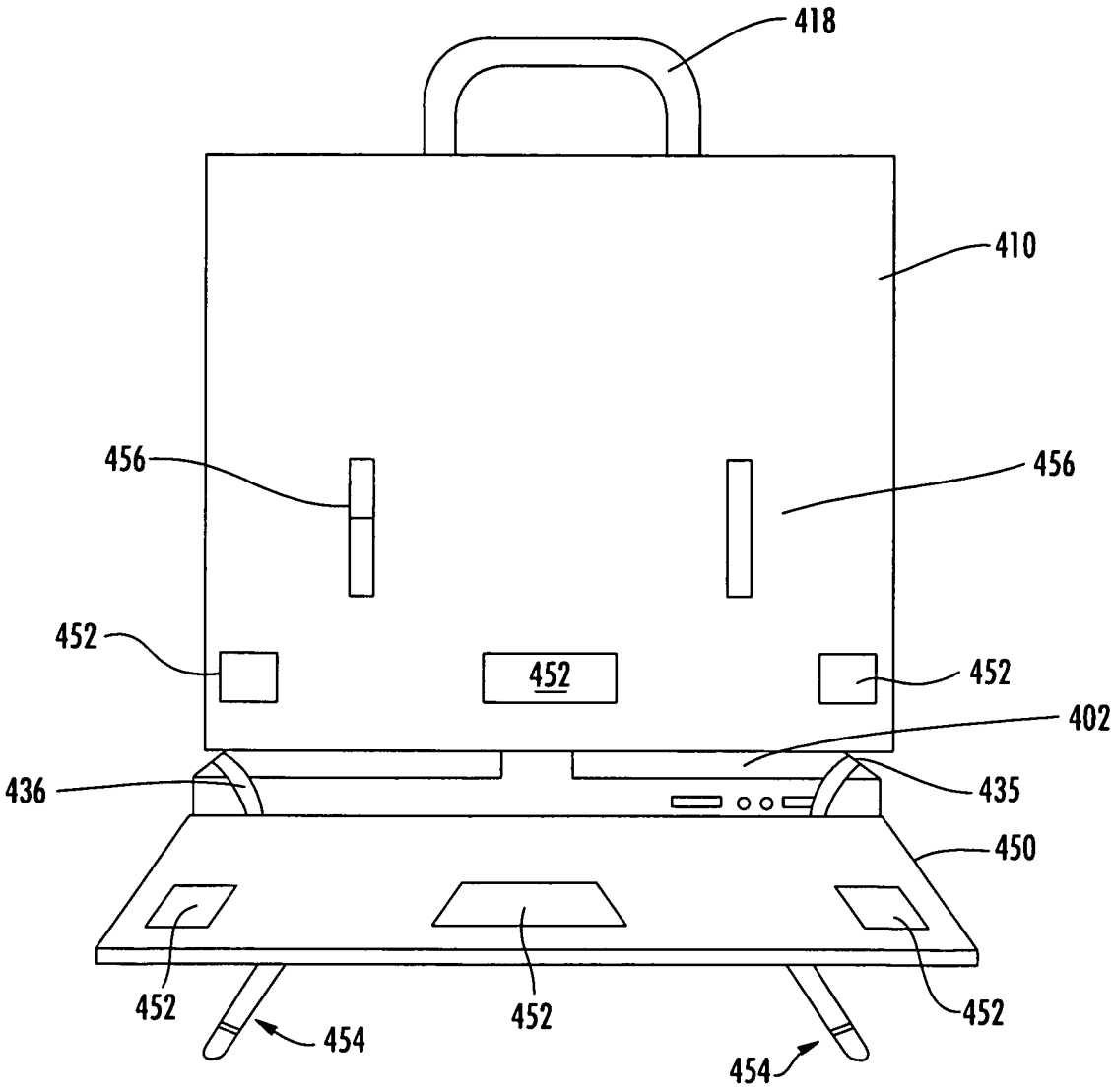

Another illustrative embodiment of the invention is shown by way of example in FIGS. 4 and 5. The case 400 is configured so as to be suitable for use with a laptop computer having a multi-axis rotatable display, sometimes also known as a tablet PC. In addition to the standard rotation involved with opening and closing of the laptop computer, the display portion can also rotate about a second axis to enable the display portion to be oriented in different directions.

Similar to the other illustrated embodiments, the case 400 includes a first portion 410 formed of a rigid material and secured to a display portion 401 of the laptop computer. First and second sockets 412, 414 and a lower band 416 may be used to secure the first portion 410 to the display portion. A second portion 430 is also formed of a rigid material and is secured to a keyboard portion 402 of the laptop computer. A third socket 432 and fourth socket (not shown), along with a fifth socket 435 and sixth socket (436) may be used to secure the second portion 430 to the keyboard portion of the laptop computer.

Because a connective portion is not attached to both the first portion 410 and second portion 430, the display portion of the laptop computer is able to rotate about both a first axis 480 and second axis 490. With reference to FIG. 5, the covering flap 450 is illustrated by way of example. The covering flap 450 is configured with fasteners, such as hook and loop fasteners 452 to selectively secure the covering flap 450 to the first portion 410. Optionally, a zipper and/or additional straps 454 having hooks with corresponding hooks 456, or other securing mechanism, may be used to secure the covering flap 450 when the case 400 is being transported, such as by the use of handle 418, so as to ensure the weight of the laptop computer does not open the covering flap 450, if the laptop computer were to become dislodged from one or more sockets.

The illustrative embodiments, implementations and examples herein are meant to be illustrative and not limiting. The present invention has been described by way of example, and modifications and variations of the exemplary embodiments will suggest themselves to skilled artisans in this field without departing from the spirit of the invention. Features and characteristics of the above-described embodiments may be used in combination. The preferred embodiments are merely illustrative and should not be considered restrictive in any way.

What is claimed is:

1. A case for a laptop computer, comprising:

a first portion formed of a rigid material and adapted to be secured to a display portion of the laptop computer;

a second portion formed of a rigid material and adapted to be secured to a keyboard portion of the laptop computer;

a connective portion connecting the first portion to the second portion to enable rotation of the first portion relative to the second portion, thereby permitting opening and closing of the laptop computer; and a covering flap selectively securable across the connective portion;

wherein the first portion and second portion remain secured to the display portion and keyboard portion, respectively, during operation of the laptop computer in an open configuration.

2. The case of claim 1, wherein the covering flap is secured to one of the group of the first portion and second portion and removably securable to the other of the group of the first portion and the second portion, and the covering flap adapted to expose a plurality of ports on a back edge of the laptop computer when the covering flap is detached from the other of the first portion and the second portion.

3. The case of claim 2, wherein the covering flap is removably securable by the use of a hook and loop fastener.

4. The case of claim 2, wherein the covering flap is removably securable by the use of a zipper.

5. The case of claim 1, wherein the first portion is planar.

6. The case of claim 1, wherein the second portion is planar.

7. The case of claim 1, further comprising at least one pocket attached to an exterior surface of the first portion.

8. The case of claim 1, further comprising a first handle attached to the first portion along a first edge opposite the connective portion and a second handle attached to the second portion along a second edge opposite the connective portion, the first handle and second handle thereby configured to enable carrying of the case with the connective portion located downward and away from the first handle and second handle.

9. The case of claim 1, wherein the connective portion comprises two straps.

10. The case of claim 1, wherein the connective portion comprises a material having holes located so as to be proximate to corresponding ports on a back edge of the laptop computer.

11. The case of claim 1, further comprising a first socket located at a first corner of the first portion away from the connective portion and a second socket located at a second corner of the first portion away from the connective portion.

12. The case of claim 11, wherein the first socket and the second socket are formed of elastic.

13. The case of claim 11, further comprising a band mounted at each end to opposite edges of the first portion and proximate to the connective portion, the band sized to permit the display portion of the laptop computer to be located between the band and the first portion.

14. The case of claim 1, further comprising a first socket located at a first corner of the second portion away from the connective portion and a second socket located at a second corner of the second portion away from the connective portion.

15. The case of claim 14, wherein the first socket and the second socket are formed of elastic.

16. The case of claim 1, further comprising a closure strap attached to at least one of group of the first portion and the second portion, opposite the connective portion and removably attached to the other of the group of the first portion and the second portion.

17. The case of claim 16, further comprising a magnet for removable attachment of the closure strap to the other of the group of the first portion and the second portion.

18. The case of claim 1, further comprising a shoulder strap attached to at least one of group of the first portion and the second portion.

19. A method of use of a laptop computer, comprising:

mounting a display portion of the laptop computer to a first portion formed of a rigid material;

mounting a keyboard portion of the laptop computer to a second portion formed of a rigid material;

locating a connective portion proximate to a plurality of ports on a back edge of the laptop computer, the connective portion connecting the first portion to the second portion to enable rotation of the first portion relative to the second portion;

opening a covering flap to expose the connective portion and the plurality of ports;

inserting at least one wire in at least one port of the plurality of ports; and inputting data into the laptop computer by the use of the keyboard portion, wherein the display portion and keyboard portion remain mounted to the first portion and second portion, respectively, during the act of inputting data into the laptop computer.

20. The method of claim 19, wherein the act of opening a covering flap comprises separating a hook and loop fastener.

21. The method of claim 19, wherein the act of mounting a display portion of the laptop computer includes locating corners of the display portion of the laptop computer in sockets mounted to the first portion and formed of elastic.

22. The method of claim 19, wherein the act of mounting a keyboard portion of the laptop computer includes locating corners of the keyboard portion of the laptop computer in sockets mounted to the second portion and formed of elastic.

23. A case for a laptop computer, comprising:

a first portion formed of a rigid material and adapted to be secured to a display portion of the laptop computer;

a second portion formed of a rigid material and adapted to be secured to a keyboard portion of the laptop computer; and a covering flap selectively securable between the first portion and the second portion to enable rotation of the first portion relative to the second portion along a first axis, thereby permitting opening and closing of the laptop computer when the covering flap is secured between the first portion and the second portion, the covering flap enabling rotation relative to a second axis of the first portion to the second portion when detached from one of the group of the first portion and second portion, thereby enabling rotation of the display portion of the laptop computer along the second axis;

wherein the first portion and second portion remain secured to the display portion and keyboard portion, respectively, during operation of the laptop computer in an open configuration.

* * * * *